United States Patent [19]

Mancini

[11] Patent Number: 4,895,078

[45] Date of Patent: Jan. 23, 1990

[54] SYSTEM FOR THE CONTINUOUS RECIPROCAL SELF-ALIGNMENT OF RAILS ON SLEEPERS

[75] Inventor: Flavio Mancini, Brescia, Italy

[73] Assignees: Danieli & C. Officine Meccaniche SpA; ITI/CLM Impianti Tecnici Industriali SpA, both of Buttrio, Italy

[21] Appl. No.: 173,815

[22] Filed: Mar. 28, 1988

[30] Foreign Application Priority Data

Apr. 10, 1987 [IT] Italy ..... 83348 A/87

[51] Int. Cl.[4] ..... E01B 33/00

[52] U.S. Cl. ..... 104/8

[58] Field of Search ..... 104/3, 7.1, 7.2, 8, 104/9, 17.2, 2

[56] References Cited

U.S. PATENT DOCUMENTS

| | | | |
|---|---|---|---|
| 2,532,745 | 12/1950 | Thornley | 104/2 X |
| 2,921,538 | 1/1960 | Croonenberghs | 104/2 X |
| 2,996,016 | 8/1961 | Keller | 104/7.1 X |
| 3,250,229 | 5/1966 | Keller | 104/7.1 |
| 3,318,259 | 5/1967 | Oville | 104/2 |
| 3,425,360 | 2/1969 | Plasser et al. | 104/8 |
| 3,486,461 | 12/1969 | Plasser et al. | 104/8 |
| 3,552,320 | 1/1971 | Traupmann | 104/2 X |
| 3,628,460 | 12/1971 | Von Beckmann | 104/8 |
| 4,125,075 | 11/1978 | Stewart | 104/7.2 |
| 4,301,738 | 11/1981 | Theurer | 104/2 |
| 4,363,274 | 12/1982 | Lund | 104/7.2 X |
| 4,534,296 | 8/1985 | Stubbs et al. | 104/8 |
| 4,669,387 | 6/1987 | Casarini et al. | 104/2 X |

FOREIGN PATENT DOCUMENTS

| | | |
|---|---|---|
| 548030 | 8/1982 | Australia . |
| 2503995 | 4/1975 | Fed. Rep. of Germany . |
| 375226 | 7/1907 | France . |

OTHER PUBLICATIONS

Railway Gazette International, vol. 127, No. 2, Feb. 1971, p. 75, London, GB; "Mechanised Track Laying".

*Primary Examiner*—Margaret A. Focarino
*Assistant Examiner*—Joseph D. Pape
*Attorney, Agent, or Firm*—Wegner & Bretschneider

[57] ABSTRACT

System for the continuous reciprocal self-alignment of rails on sleepers, which comprises pre-installed bolts or like locking means in cooperation with a machine which lays, positions and secures the elements that clamp the rails, the rails being first anchored and positioned relative to each other and then positioned relative to the sleepers.

10 Claims, 2 Drawing Sheets

SYSTEM FOR THE CONTINUOUS RECIPROCAL SELF-ALIGNMENT OF RAILS ON SLEEPERS

This invention concerns a system for the continuous reciprocal self-alignment of rails on sleepers as employed to support and position the rails.

In particular, the invention concerns rail-sleeper systems which provide for the positioning of alignment means between the upper surface of the sleeper and the foot of the rail.

Sleepers to which rails are fitted for the passage of trains are known.

Some types of sleepers comprise pre-positioned anchorage bolts during the phase of the beginning of instalment of the rails.

With such a type of sleeper it is necessary to be able to position the rails correctly in relation to each other and also to be able to position the sleepers and therefore the bolts in relation to the rails.

Such type of sleeper is laid on the railway roadbed, the bolts having been correctly positioned beforehand and therefore located on the two sides of each single rail. Thereafter each single rail is positioned freely between the bolts.

It is therefore necessary to tackle the problem of positioning the bolts and therefore the sleepers correctly in relation to the rails and of positioning the rails themselves correctly in relation to each other.

Moreover, continuous plates or continuous sleepers exist which extend lengthwise to the track without any substantial gap.

In this case too the rails have to be positioned correctly in relation to each other and in relation to the continuous plates or sleepers.

The present applicants have designed this invention to overcome the above problems.

According to the invention both rails are clamped reciprocally with a fixture frame so as to form one single rigid whole.

In the case of discontinuous sleepers having pre-set reference positions consisting of pre-positioned bolts or other analogous elements, aligment means position the sleeper in relation to the fixture frame.

In the case of continuous sleepers the fixture frame is positioned in relation to reference positions on the continuous sleeper; these reference positions may be anchorage bolts or other means.

According to the invention a feeler is provided which is solidly fixed to the fixture frame and cooperates with the bolts or with other reference elements suitable for the purpose.

Where bolts are used as the reference elements, the bolts located on one side of the rail are so used.

The feeler monitors the position of the bolts or other reference elements in relation to the rail and enables the required lateral, reciprocal positioning of the sleeper and fixture frame and therefore of the sleeper and rails to be obtained.

The invention is therefore embodied with a system for the continuous reciprocal self-alignment of rails on sleepers, which comprises pre-installed bolts or like locking means in cooperation with a machine which lays, positions and secures the elements that clamp the rails, the system being characterized in that the rails are first anchored and positioned relative to each other and are then positioned relative to the sleepers.

The attached figures, which are given as a non-restrictive example, show the following:

Figure 1:
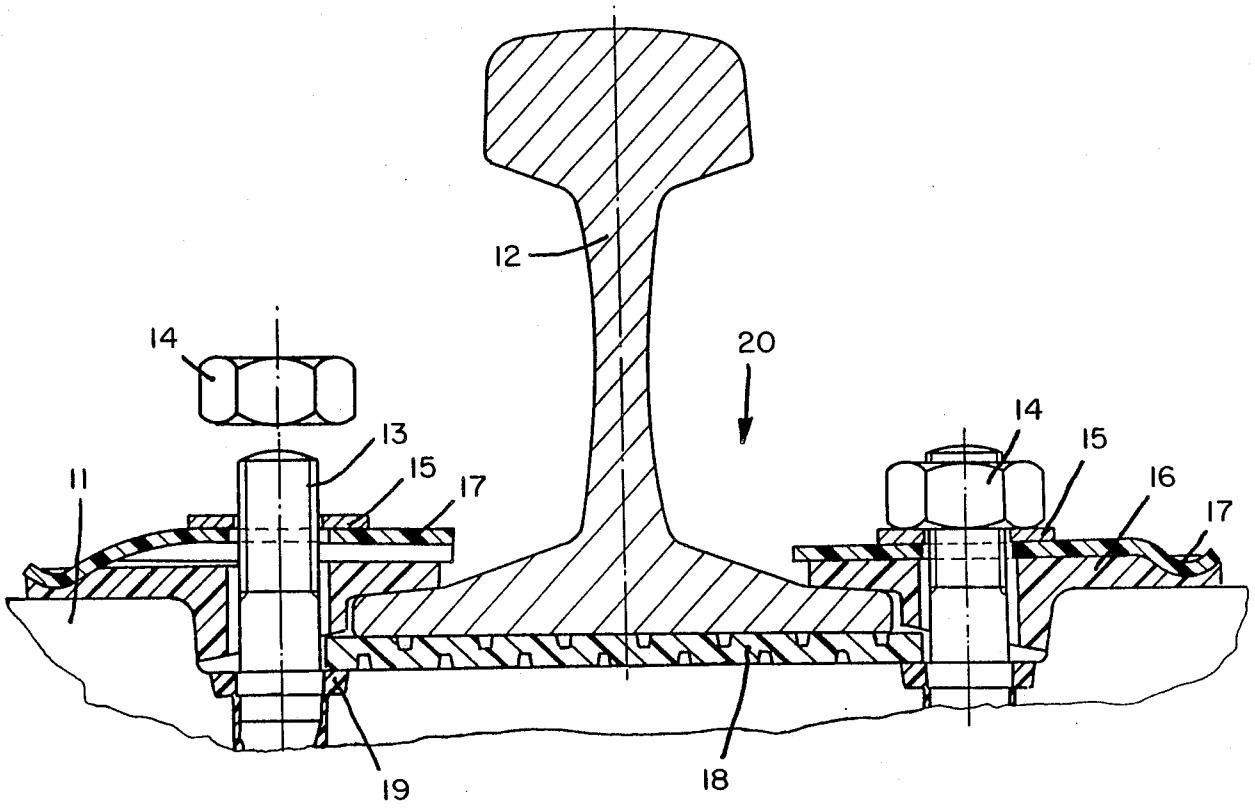
FIG. 1 shows a possible installation of a rail on a sleeper.
Figure 2:
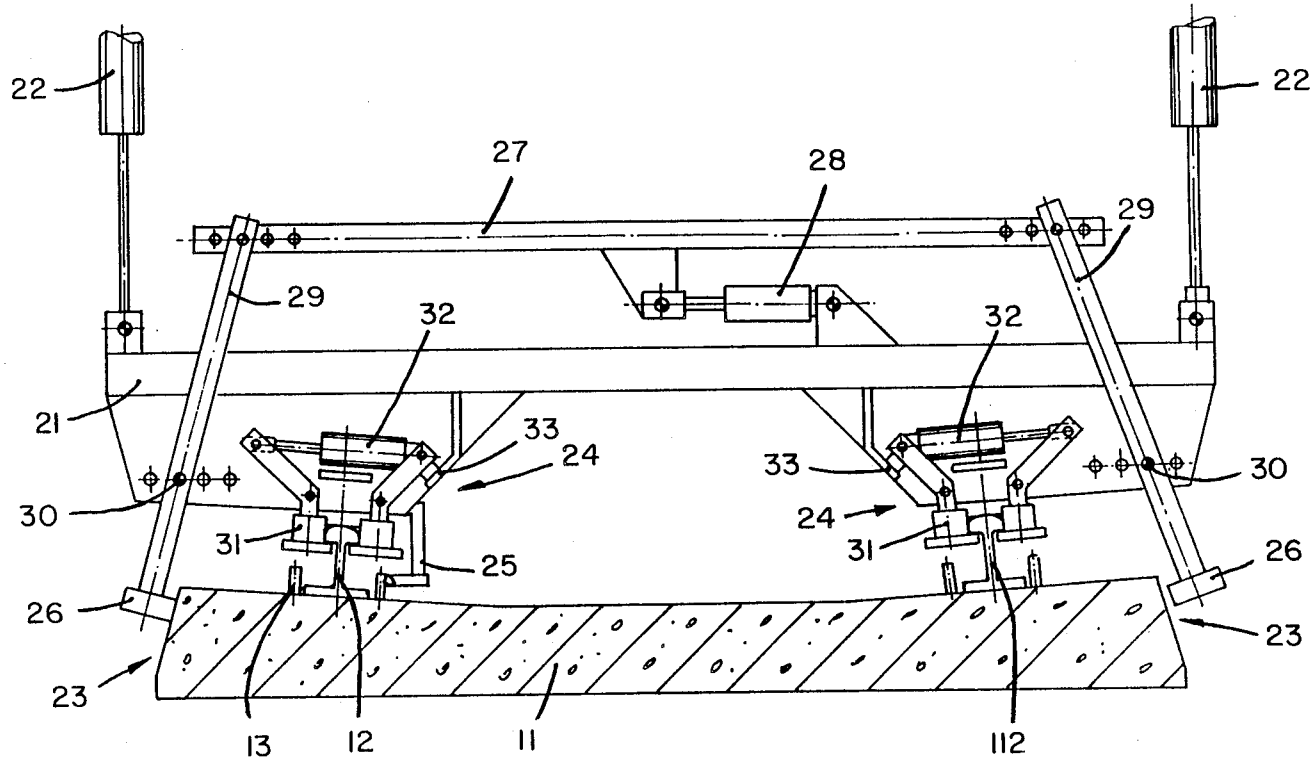
FIG. 2 shows the system for positioning the sleeper in relation to the fixture frame and the rails.

In the example shown each rail 12 is positioned in an appropriate continuous seating 20 included lengthwise in a sleeper 11.

The sleeper 11 as shown represents one single sleeper to be employed side by side with a plurality of other sleepers in supporting and positioning the rails 12.

However, in a variant the sleeper 11 may also have the cross section of a continuous plate or sleeper platform that supports the rails 12.

The sleeper 11 comprises in its continuous seating 20 bolts 13 already correctly positioned and fixed solidly to the sleeper by an anchorage 19.

The bolts 13 may be replaced with equivalent fixture elements without departing thereby from the spirit of the invention.

In the example shown, when the sleeper 11 has been properly located, a sole plate 18 is fitted and the rail 12 is then positioned.

The rail 12 is correctly installed in relation to the other parallel rail 112.

Thereafter an alignment element 16 is positioned on which a resilient pressure element 17 is installed; a washer 15 is then fitted and the assembly is then clamped by a nut 14.

The problem to be overcome is the correct positioning of the sleeper 11 and therefore bolts 13 in relation to the two rails 12 and of the rails in relation to each other.

According to the invention a fixutre crossbar frame 21 is provided which can be positioned vertically by jacks 22; the whole assembly is supported on a frame of a machine that lays, positions and secures elements which clamp the rails; the machine is not shown as this is not necessary for the understanding of the invention.

The crossbar frame 21 bears a second frame comprising positioner rods 27 and 29, which are pivoted on pivots 30 on the crossbar frame 21.

The vertical or almost vertical rods 29 comprise at their ends guide and thrust rollers 26 suitable to cooperate with a lateral profile 23 of the sleeper 11.

A jack 28 connectes the crossbar frame 21 to the substantially horizontal positioner rod 27 in a movable manner.

Clamp assemblies 24 are correctly lodged and positioned in a stationary manner in relation to each other on the cross bar frame 21. These clamp assemblies 24 can be actuated by a jack 32 and comprise clamping grippers 31 which cooperate with the head of the rails 12.

Positioner supports 33 may be provided if the clamping grippers 31 are able to oscillate.

When the rails 12 and 112 have been engaged by the grippers 31 on the clamp assembly 24, they are properly positioned in relation to each other and also to the crossbar frame 21. The grippers 31 consist advantageously of rollers.

The crossbar frame 21 includes a feeler assembly 25, which is solidly fixed to the crossbar frame and is suitable to feel the position of one or the other of the bolts 13 or other reference elements suitable for the purpose in attachments other than that shown.

In the example shown the feeler assembly 25 serves to control the position of the bolt 13 located on the inner side of the rail 12.

When the feeler assembly 25 comes into contact with the bolt 13 of the rail 12, it feels the position of the bolt and therefore the position of the rail 12 in relation to the bolt. The feeler assembly 25 can therefore check the reciprocal positions of the bolts 13 and rails 12–112 and can therefore give the jack 28 the right command for the proper lateral positioning of the sleeper 11 in relation to the rails 12–112.

The horizontal positioner rod 27 acts on one or the other of the lateral profiles 23 of the sleeper by means of the rollers 26 and constrains the sleeper to move sideways.

The system therefore obtains the exact positioning of the rails 12 and 112 between the relative pairs of bolts 13.

The reciprocal positioning of the rails 12–112 and of the rails 12 and 112 and bolts 13 is secured by installation of the alignment element 16, pressure element 17 and washer 15, the whole assembly being clamped with the nut 14.

The positoner rods 27 and 29 comprise various reciprocal anchorages for adaptation to various widths of the sleeper 11 and also comprise various anchorages for the same purpose in relation to the crossbar frame 21.

In a variant the sleeper 11 is continuous along the length of the rails 12 and 112 and comprises properly pre-positioned bolts 13 or equivalent elements.

The crossbar frame 21 can oscillate sideways owing to the action of the rods 27 and 29 and rollers 26 cooperating with one or the other fixed point consisting of the lateral profile 23 of the continuous sleeper 11.

In this manner the correct positioning of the crossbar frame 21 and therefore of the rails 12 and 112 solidly secured to the frame is obtained in relation to the continuous sleeper 11.

I claim:

1. A process for continuously positioning and aligning two rails on sleepers, each of said sleepers having locking means for locking the rails thereon, said process comprising:

positioning and securing the rails relative to each other at a predetermined distance apart; then positioning the rails at a proper position on one of the sleepers, the proper position being determined with respect to a lateral profile of the sleeper; and then locking the rails on said one of the sleepers using the locking means of said one of the sleepers.

2. The process as claimed in claim 1, wherein said locking means comprises a bolt attached to each of the sleepers, and wherein said step of positioning the rails on one of the sleepers comprises positioning the rails a predetermined distance from the bolt of the one of the sleepers.

3. An apparatus for continuously positioning and aligning two rails on sleepers, each of said sleepers having locking means for locking the rails thereon, said apparatus comprising:

a crossbar frame;

means for gripping the rails and securing the rails at a predetermined position relative to said crossbar frame; and means for positioning said crossbar frame at a predetermined position relative to a lateral profile of one of said sleepers so as to properly position the rails relative to the one of the sleepers.

4. The apparatus as claimed in claim 3, wherein said gripping means comprises two grippers fixed to the crossbar frame and actuating means for actuating said grippers.

5. An apparatus for continuously positioning and aligning two rails on sleepers, each of said sleepers having locking means for locking the rails thereon, said apparatus comprising:

a crossbar frame;

means for gripping the rails and securing the rails at a predetermined position relative to said crossbar frame;

means for positioning said crossbar frame at a predetermined position relative to one of said sleepers so as to properly position the rails relative to the one of the sleepers, said positioning means comprising a second frame oscillatably mounted on said crossbar frame, said second frame having a horizonal positioner rod, two vertical positioner rods, and thrust rollers attached to ends of the vertical rods which cooperate with lateral sides of the one of the sleepers.

6. The apparatus as claimed in claim 5, wherein said vertical positioner rods are pivotably connected to the crossbar frame and to opposing ends of the horizontal positioner rod.

7. The apparatus as claimed in claim 6, further comprising oscillating means fixed to said crossbar frame and to said horizontal positioner rod for oscillating said second frame.

8. The apparatus as claimed in claim 7, wherein said crossbar frame is moved sideways when said oscillating means oscillates said second frame.

9. The apparatus as claimed in claim 5, wherein said positioning means further comprises a feeler fixed to said crossbar frame which determines when the rails are properly positioned relative to the one of the sleepers.

10. The apparatus as claimed in claim 9, wherein said locking means comprises a bolt attached to each of the sleepers, and wherein said feeler contacts the bolt of the one of the sleepers when the rails are properly positioned relative to the one of the sleepers.

* * * * *